US010828516B2

(12) United States Patent
Chabod

(10) Patent No.: US 10,828,516 B2
(45) Date of Patent: Nov. 10, 2020

(54) PULLEY DESCENDER

(71) Applicant: ZEDEL, Crolles (FR)

(72) Inventor: Pierre-Olivier Chabod, Pontcharra (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 16/520,498

(22) Filed: Jul. 24, 2019

(65) Prior Publication Data

US 2020/0031638 A1 Jan. 30, 2020

(30) Foreign Application Priority Data

Jul. 24, 2018 (FR) ..... 18 56877

(51) Int. Cl.

| | |
|---|---|
| ***A62B 1/14*** | (2006.01) |
| ***B66D 3/04*** | (2006.01) |
| ***A62B 1/10*** | (2006.01) |

(52) U.S. Cl.

CPC ..... *A62B 1/14* (2013.01); *A62B 1/10* (2013.01); *B66D 3/046* (2013.01); *B66D 2700/026* (2013.01)

(58) Field of Classification Search

CPC .... A62B 1/00; A62B 1/06; A62B 1/08; A62B 1/10; A62B 1/14; A63B 29/00; A63B 29/02; B66D 3/10; B66D 3/046; B66D 2700/026; B66D 2700/03

See application file for complete search history.

(56) References Cited

U.S. PATENT DOCUMENTS

| | | | | |
|---|---|---|---|---|
| 6,068,242 | A * | 5/2000 | Kingery | B66D 3/04 254/391 |
| 7,419,138 | B1 | 9/2008 | Mauthner | |
| 7,658,264 | B2 | 2/2010 | Mauthner | |
| 8,596,615 | B2 * | 12/2013 | Kommer | B66D 3/10 254/391 |
| 9,120,654 | B2 | 9/2015 | Chaumontet | |
| 2014/0262611 | A1 | 9/2014 | Oddou et al. | |
| 2016/0296771 | A1 | 10/2016 | Malcolm | |
| 2019/0030376 | A1 | 1/2019 | Malcolm | |

FOREIGN PATENT DOCUMENTS

| | | |
|---|---|---|
| RU | 2 137 519 C1 | 9/1999 |
| WO | 2016/164613 A1 | 10/2016 |

* cited by examiner

*Primary Examiner* — Sang K Kim
*Assistant Examiner* — Nathaniel L Adams
(74) *Attorney, Agent, or Firm* — Oliff PLC

(57) ABSTRACT

The self-clamping descender with pulley includes a first flange with a side wall defining a rope channel, a pulley fitted in rotary manner with respect to the first flange around a first axis of rotation, the pulley only rotating in a first direction of rotation around the first axis of rotation. The first axis of rotation is fitted movable with respect to the side wall of the first flange so as to define a first position and a second position presenting different distances with respect to the side wall of the first flange. Clamping of the pulley in the second direction of rotation results in movement of the first axis of rotation and pulley in the direction of the side wall of the first flange up to a threshold position.

12 Claims, 8 Drawing Sheets

PULLEY DESCENDER

BACKGROUND OF THE INVENTION

The invention relates to a self-clamping pulley descender with improved operation and more particularly to a self-clamping pulley descender able to support heavy loads in the form of a self-clamping pulley.

STATE OF THE ART

In mountaineering and other mountain activities, it is commonplace to have a clamping pulley that can be used in the event of a fall into a crevasse or to hoist any heavy load. Such a clamping pulley has to have a good efficiency when it is used as a pulley and also the ability to clamp the rope efficiently. Finally, the blocking pulley has to be lightweight and compact as the equipment is always at hand in the rucksack and is very seldom used.

In professional fields, and in particular for rescue operations, it is also necessary to have a clamping pulley at hand. The constraints on use are different as the pulley is used more regularly on much heavier loads. Furthermore, when performing a rescue operation, it is particularly advantageous to also have the possibility of lowering a victim who has previously been raised. It is advantageous to use a self-clamping descender with a pulley.

Under these conditions, the use of a clamping pulley such as the one presented in the document U.S. Pat. No. 9,120,654 is not suitable.

For professional use, it is known to use a pulley descender marketed under the tradename "MAESTRO" by the applicant. Such a descender comprises a pulley configured to only rotate in one direction around its spindle. The descender also comprises a rotary cam configured to clamp the rope when the movement of the rope is designed to generate a rotation of the pulley in the second direction of rotation.

In this configuration, the cam is in permanent or almost permanent contact with the rope so that the movement of the rope to generate the second direction of rotation of the pulley results in rotation of the cam to a clamping position.

The inventors observed that the speed of clamping varies in non-negligible manner with the surface quality of the rope and with the temperature of the descender.

An identical finding can be drawn from the pulley with descender marketed by the CMC company under the tradename CSR2 PULLEYS and presented in the document U.S. Pat. No. 7,419,138. This solution is not suitable as it does not enable heavy loads to be supported on the rope so that slipping may occur leading to heating of the pulley resulting in a drop of the friction coefficient between the pulley and the rope.

It is also apparent that the device marketed by the CMC company under the tradename MPD™ Multi Purpose Device does not provide a satisfactory result. Such a product is presented in the document U.S. Pat. No. 7,658,264 and has a pulley fitted movable around a spindle. The pulley is associated with a cam also fitted movable around the spindle. The pulley is configured so as to only allow one direction of rotation. When a traction is exerted on a rope strand in the second direction of rotation, this results in clamping of the pulley. The friction between the rope and pulley makes the pulley rotate until the rope is clamped by means of the cam. It is necessary to have a sufficient friction to counteract the force provided by a resistance spring that places the cam in a position preventing any clamping of the rope.

As indicated in the document U.S. Pat. No. 7,658,264, clamping of the rope is largely dependent on the friction between the rope and pulley which results in a large variability of the quality of clamping depending on the state of wear of the rope and of the pulley.

OBJECT OF THE INVENTION

One object of the invention is to remedy these shortcomings by proposing a descender with a pulley that improves clamping of the rope, in particular by means of a configuration in which the variation of the friction coefficient presents a lesser importance in clamping of the rope.

For this purpose, the pulley descender comprises:

- a first flange provided with a side wall defining a rope clamping area,
- a blocking cam movable in rotation with respect to the first flange so as to move towards or away from the rope clamping area,
- a pulley designed to come into contact with the rope and fitted in rotary manner with respect to the first flange around a first shaft defining a first axis of rotation, the pulley being configured to rotate only in a first direction of rotation around the first axis of rotation and to prevent rotation in the second direction of rotation around said first axis of rotation, the cam being salient from the pulley.

The self-clamping pulley descender is remarkable in that:

- the first shaft is mounted movable with respect to the clamping area to move the first axis of rotation,
- the cam is mounted movable around a second axis of rotation defined by a second shaft different from the first shaft so that the position of the cam with respect to the clamping area is linked to the position of the first shaft, and
- the first axis of rotation is offset from the second axis of rotation so that application of a force on the rope to make the pulley rotate in the first direction of rotation generates a force urging the cam away from the clamping area and application of a force on the rope to make the pulley rotate in the second direction of rotation generates a force urging the cam towards the clamping area.

Advantageously, the spring is arranged to apply a force urging the cam towards the rope clamping area. In a preferential embodiment, the spring is arranged so as to move the first axis of rotation to a first position. Application of a force on the rope to obtain rotation of the pulley in the first direction of rotation results in the first axis of rotation being moved away from the first position.

In one development, the first axis of rotation is fitted movable in rotation with respect to the first flange around the second axis of rotation, the first axis of rotation being movable in the first direction of rotation and the second direction of rotation with respect to the second axis of rotation, clamping of the pulley in the second direction of rotation resulting in movement of the first axis of rotation and of the pulley in the second direction of rotation around the second axis of rotation.

Preferentially, the first axis of rotation is offset from the second axis of rotation so that application of a force on the rope to make the pulley rotate in the first direction of rotation generates a moment tending to move the cam away from the clamping area and relaxation of said force results in movement of the cam towards the clamping area.

In a preferential embodiment, when the pulley moves in the first direction of rotation, the pulley is in a first position that is farther away from the rope clamping area than a second position representative of clamping of the rope.

Advantageously, rotation of the pulley and of the first axis of rotation in the second direction of rotation results in rotation of the cam around the second axis of rotation to move the cam towards the clamping area.

It is advantageous to provide for the cam to be fitted in fixed manner on the second axis of rotation or on the first axis of rotation.

In preferential manner, the first flange comprises a first groove. The pulley and second axis of rotation are mounted on a support associated with a first pin passing through the first groove. Movement of the first pin along the first groove results in rotation of the support in the first direction of rotation. The descender is provided with a handle comprising a stop arranged to come into contact with the first pin, rotation of the handle in the first direction of rotation resulting in rotation of the first pin in the first direction of rotation.

It is also possible to provide for the first flange to comprise a second groove. The support is associated with a second pin passing through the second groove, a spring being attached to the first flange to move the second pin in the second direction of rotation.

In another embodiment, the spring is fitted around the second axis of rotation.

Preferentially, the pulley comprises a ratchet wheel associated with at least one clamp and with a blocking spring. The ratchet, the at least one clamp and the blocking spring are arranged to allow rotation of the pulley in the first direction of rotation and to prevent rotation in the second direction of rotation.

In a preferential embodiment, the pulley comprises a plurality of flat spots arranged in a groove of the pulley so as to define constrictions in the groove.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
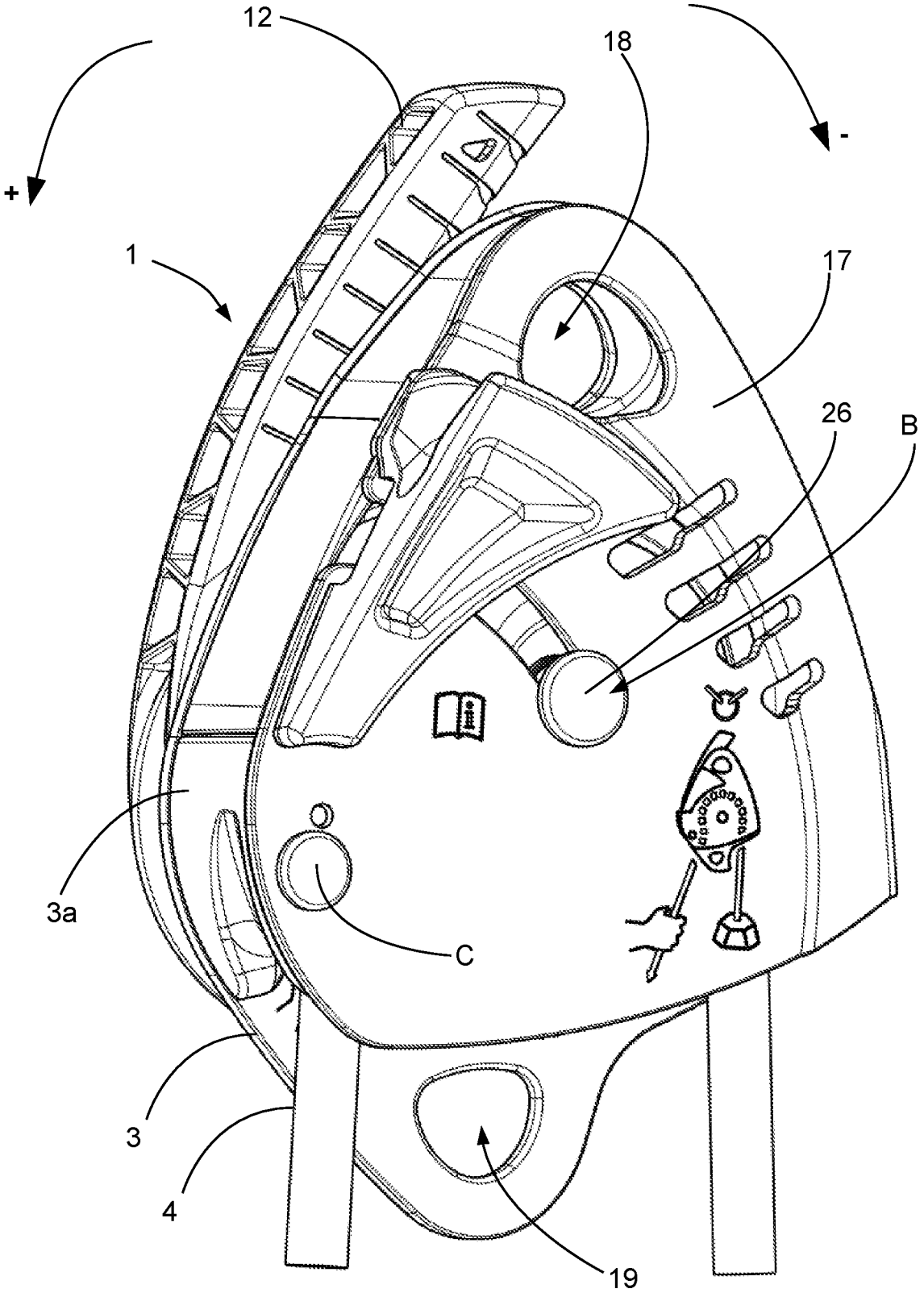
FIG. 1 illustrates, in schematic manner, in perspective, a closed self-clamping descender with a rope fitted therein.
Figure 2:
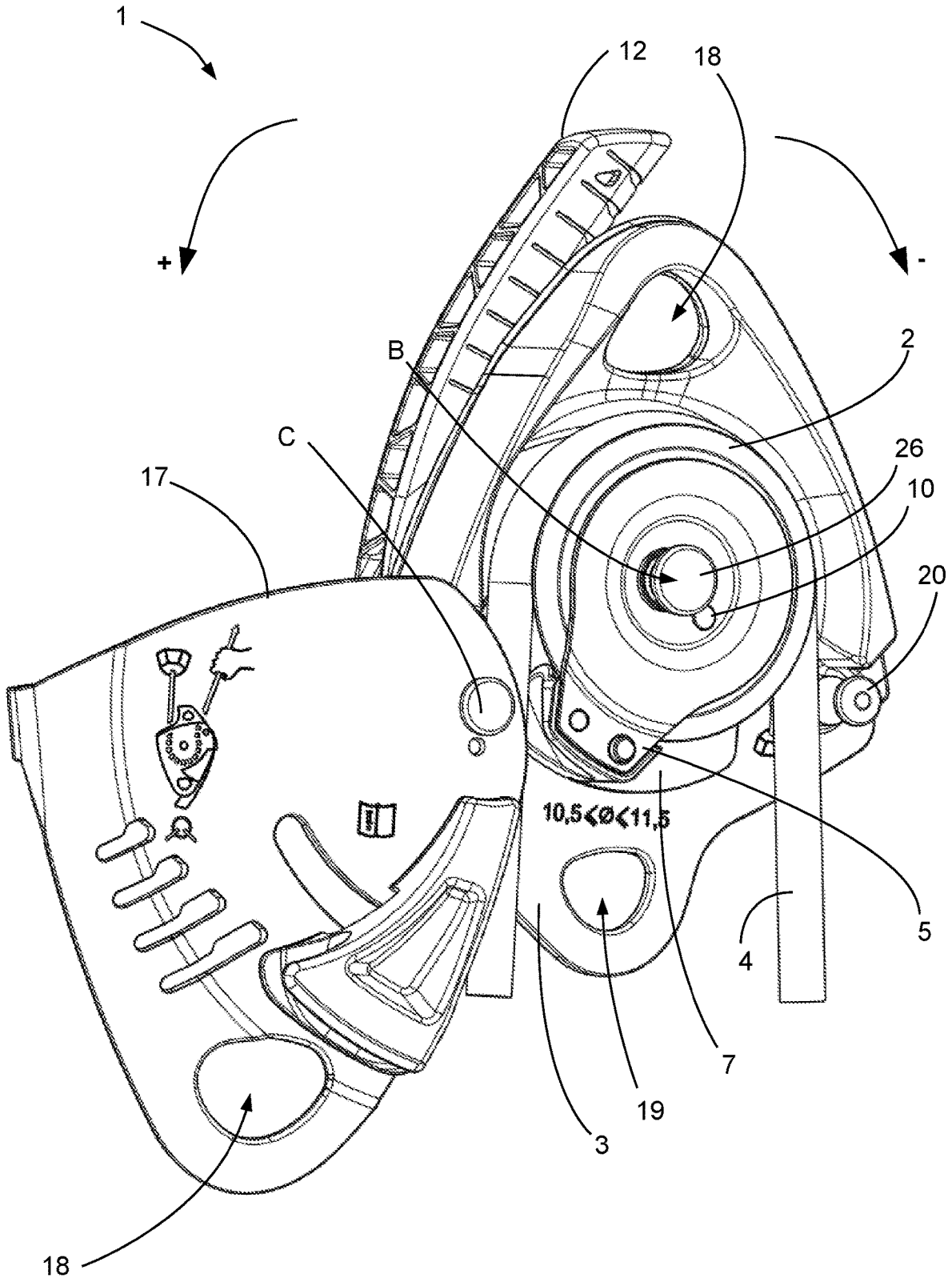
FIG. 2 illustrates, in schematic manner, in perspective, an open self-clamping descender with a rope fitted therein.

FIGS. 1 and 2 represent perspective views of a self-clamping descender 1 with a pulley 2. Self-clamping descender 1 has a first flange 3 provided with a side wall 3*a* defining a rope channel inside descender 1. The self-clamping descender defines two inlet/outlet openings of the rope 4 in descender 1. The rope enters the self-clamping descender via a first opening, passes over pulley 2 and exits from the descender via the second opening. The rope is divided into a first strand and a second strand depending on whether one is on one side of pulley 2 or the other. As illustrated in FIGS. 1 and 2, the descender has a rope channel that is designed to receive rope 4. In operation, rope 4 runs inside the rope channel. The rope channel has a support wall that makes the mechanical connection with rope 4. When the rope is taut, it presses against the support wall thereby applying a force on the descender.

FIG. 1 represents a closed descender whereas FIG. 2 represents an open descender. Opening of descender 1 enables rope 4 to be fitted in place or removed. Closing of descender 1 enables rope 4 to be secured in descender 1.

Figure 8:
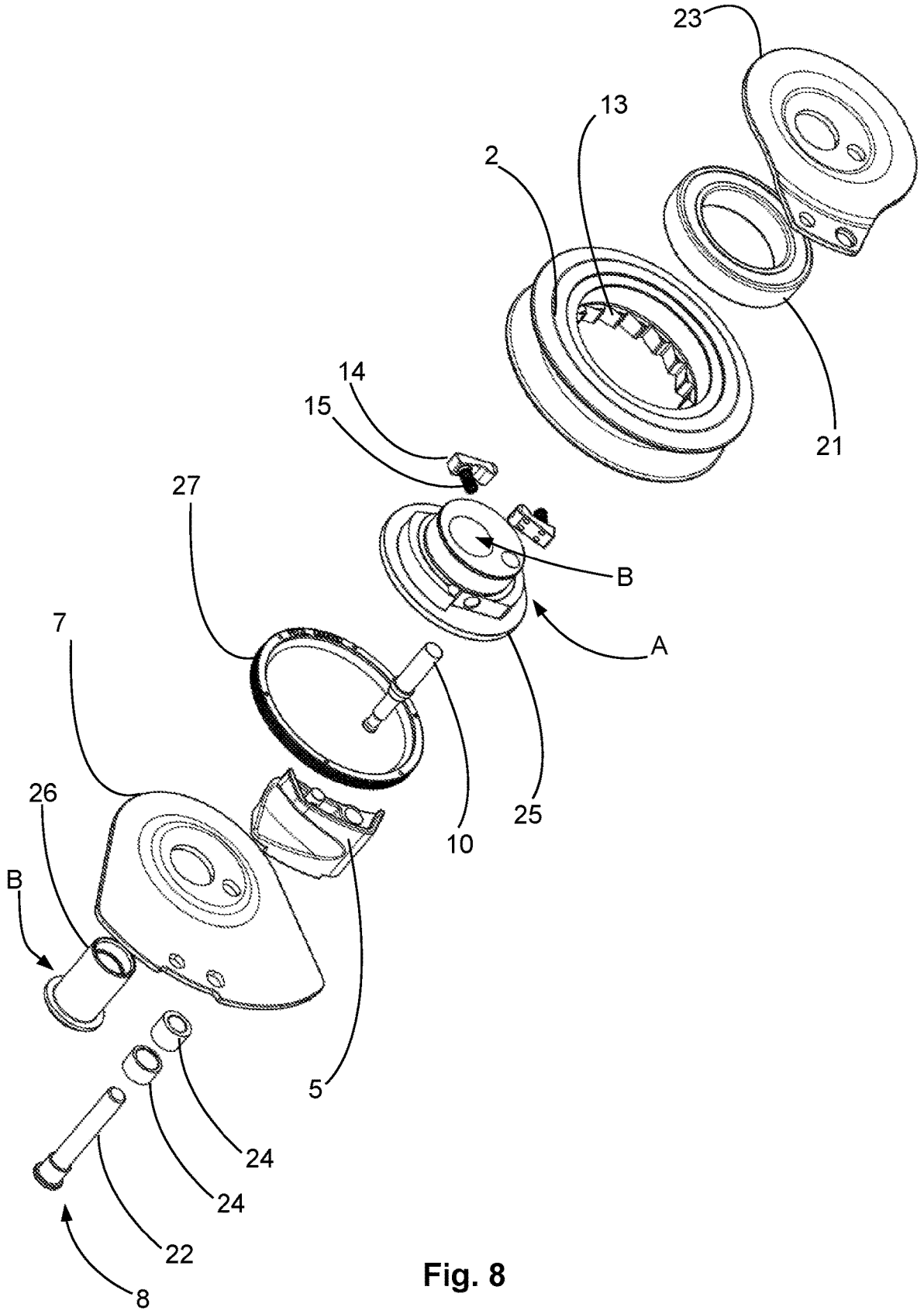
FIG. 8 illustrates in schematic manner, an exploded view of installation of a pulley and a cam on a support.

Descender 1 comprises a pulley 2 that is fitted in rotary manner with respect to first flange 3. Pulley 2 rotates around a first axis of rotation A. Pulley 2 is fitted on a first shaft 26 which defines first axis of rotation A. Shaft 26 is illustrated in FIG. 8 for example.

Pulley 2 is configured to only rotate in one direction of rotation. In other words, pulley 2 presents an autorotation and is configured to rotate in a first direction of rotation noted + and is configured to be blocked when a rotation is to be performed in the second direction of rotation noted −, opposite from the first direction of rotation.

In this way, when the user pulls on a first strand of rope 4, pulley 2 rotates in the first direction of rotation. On the contrary, when the user pulls on the second strand of rope 4, pulley 2 is blocked.

In addition to being fitted movable in rotation around first axis of rotation A, pulley 2 is also fitted movable with respect to first flange 3 to move between first and second positions.

Figure 3:
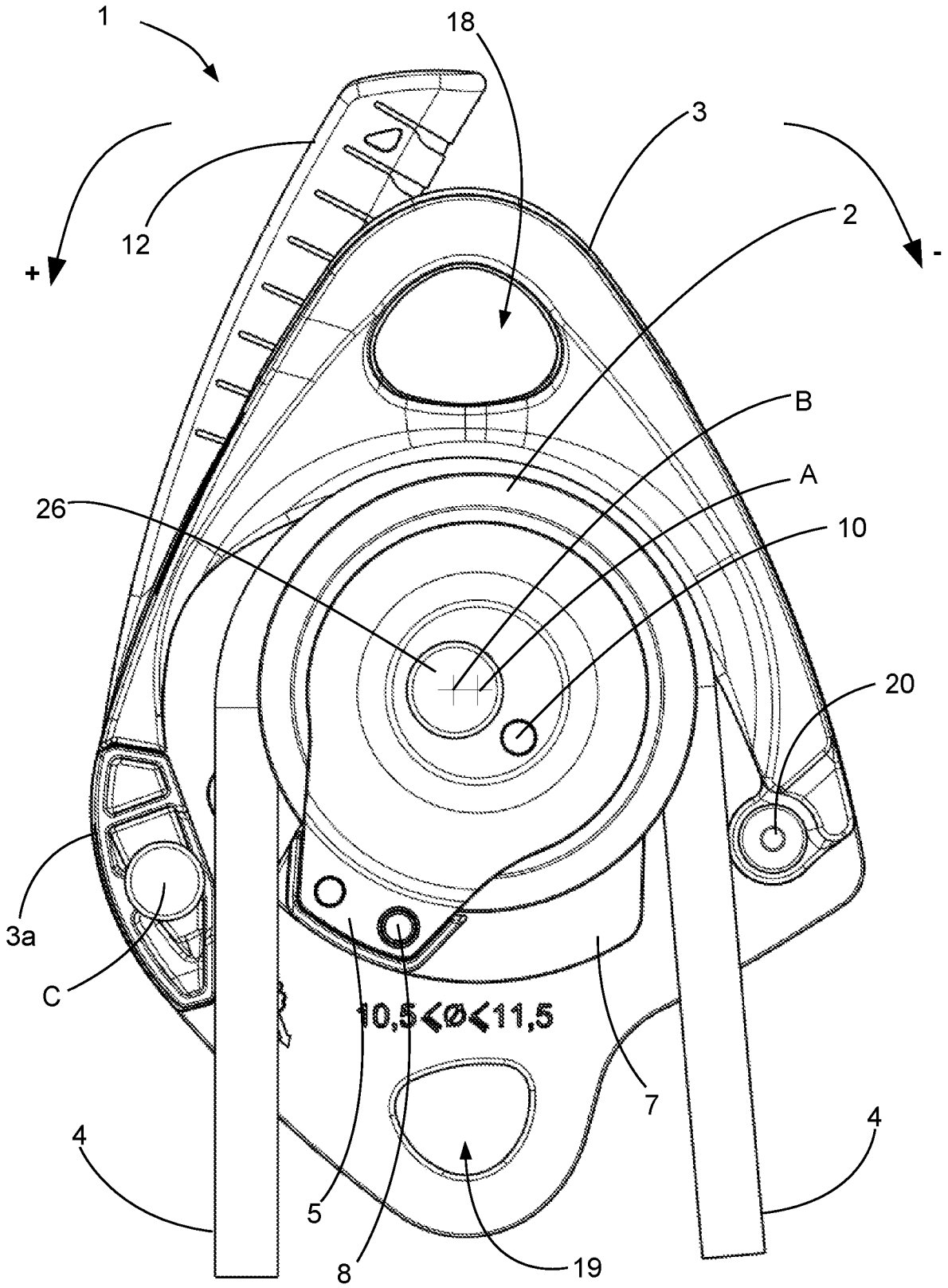
FIG. 3 illustrates, in schematic manner, in front view, an embodiment in which the cam is in the standby position, the second flange being absent.
Figure 4:
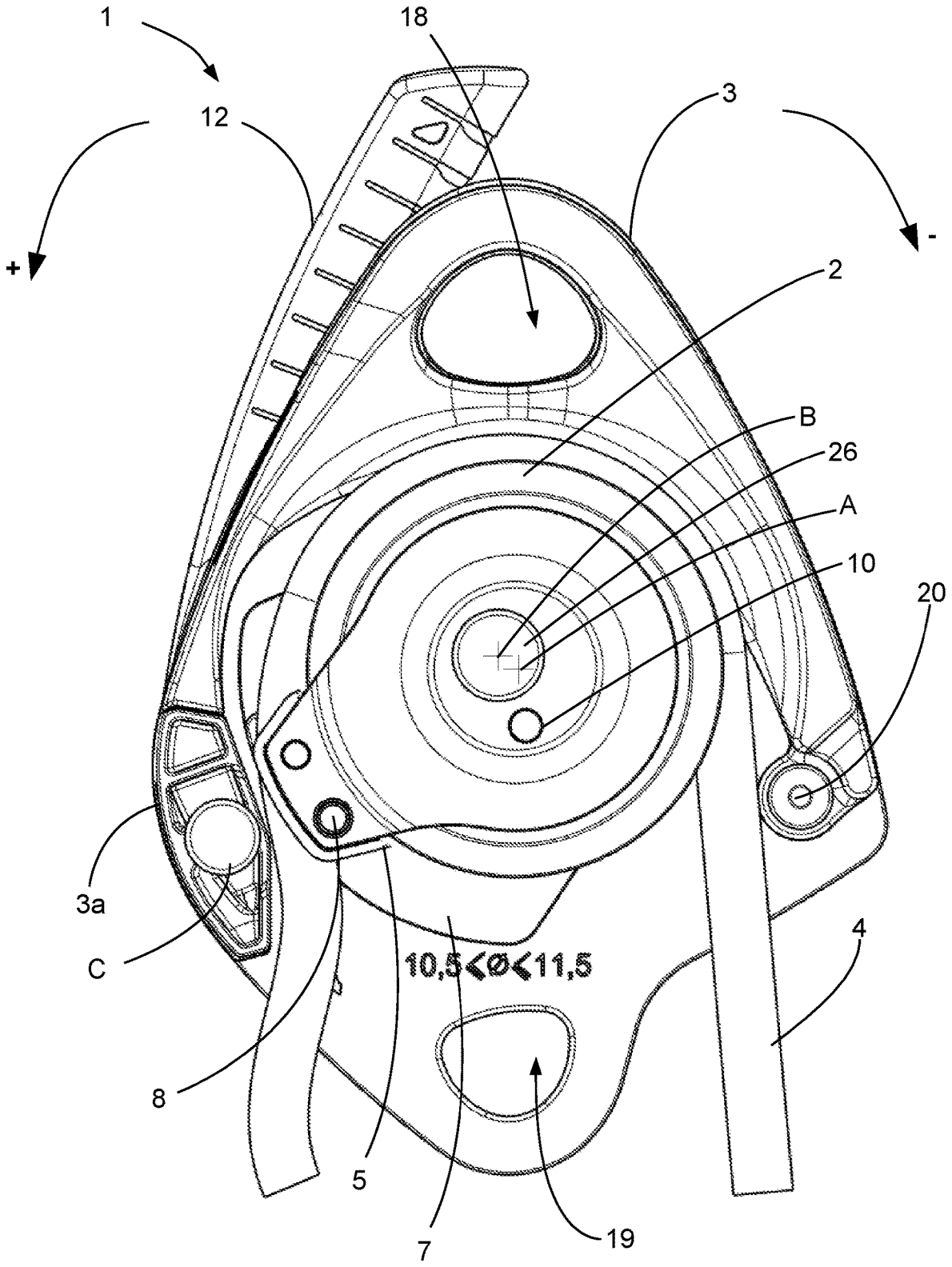
FIG. 4 illustrates, in schematic manner, in front view, an embodiment in which the cam is in the clamping position.

FIG. 3 represents pulley 2 in the first position whereas FIG. 4 represents pulley 2 in the second position. The second position is closer to side wall 3*a* than the first position thereby enabling a clamping position of the rope to be defined. The first position allows rope 4 to slide with respect to descender 1 in a configuration equivalent to a rotation of the pulley in the second direction of rotation. As pulley 2 is blocked in the second direction of rotation, movement of rope 4 takes place by sliding.

When the second strand of rope 4 (right-hand strand in FIGS. 3 and 4) is pulled, pulley 2 is blocked resulting in movement of pulley 2 to the second position and results in blocking of rope 4. As an alternative, when the second strand of rope 4 is pulled, an additional force is applied to clamp rope 4.

This embodiment is particularly advantageous on account of the fact that rope 4 is in direct contact with pulley 2 thereby increasing the contact surface used to move to the clamping position. The increased contact surface between pulley 2 and rope 4 facilitates movement of pulley 2 to the clamping position. Due to the fact that pulley 2 is stationary as it is unable to rotate in the second direction of rotation, the friction of rope 4 on pulley 2 is used to reach the threshold clamping position.

In configurations of the prior art, the pulley is only fitted movable in rotation around its spindle so that the tension applied on the second strand of the rope clamps the pulley. Once the pulley has been clamped, movement of the rope generates a friction force against a spring to move a cam and to reach the clamping position of the rope. As the cam has a small surface, it is more difficult to achieve a sufficient friction of the rope on the cam for the cam to reach the clamping position. It is also difficult to have a sufficient friction between the rope and pulley to counteract the effect of the spring and to ensure adequate triggering of clamping. If the force generated by the spring is too weak, this can clamp the rope inadvertently. It is also known to have a configuration without a cam with the pulley performing clamping of the rope. In the latter configuration, clamping is limited as the movement of the pulley spindle is necessarily small. The latter solution does not enable high clamping forces to be produced and is greatly dependent on the quality of the contact between the rope and pulley.

Movement of pulley 2 can be of any kind to reach the threshold clamping position. It is possible to use a translational movement, a rotational movement or a combination of these two movements. In particularly advantageous manner, a rotational movement is preferred as this enables the force applied on pulley 2 to be better controlled as regards the tension present in rope 4.

In the illustrated embodiment, first axis of rotation A is fitted movable in rotation with respect to first flange 3 around a second axis of rotation B different from first axis of rotation A. First axis of rotation A is movable in first direction of rotation + and in second direction of rotation − with respect to second axis of rotation B. Clamping of pulley 2 in second direction of rotation − results in movement of first axis of rotation A and pulley 2 in the second direction of rotation around second axis of rotation B so that the distance between pulley 4 and side wall 3*a* of first flange 1 decreases up to the threshold position where clamping takes place. On the contrary, rotation of pulley 2 can result in movement of first axis of rotation A away from a clamping position of rope 4.

To gain in efficiency when rotation of the pulley takes place, when pulley 2 moves in first direction of rotation +, pulley 2 is outside the second position and preferably in the first position that is farther from side wall 3*a* than the second position. In this way, when rotation of pulley 2 takes place, rope 4 does not have to overcome a high friction force which enables a high level of performance to be kept when hoisting a load fixed to the second strand. As illustrated in FIGS. 1 and 2, the support wall of the rope channel is exclusively formed by the pulley thereby avoiding the presence of friction areas on the rope. When the left-hand strand (FIG. 3) of the rope is pulled to move away from the pulley, a portion of rope 4 of the right-hand strand enters the descender to come into contact with the pulley. The pulley rotates to move the portion of rope until the portion of rope exits from the descender. During its movement in the descender, the portion of rope was only in contact with the pulley thereby limiting the friction of the rope inside the descender. As illustrated in the different figures, the support wall of the rope channel defines a semi-circle that is formed by pulley 2 thus enhancing the quality of contact between the rope and the pulley. The pulley takes up the force in the first position and the second position of support 7. The pulley defines the rope channel with a semi-circle having a radius corresponding to the radius of the pulley in the groove.

The inner wall of the rope channel defines a semi-circle that corresponds to half of the pulley. The weight of the load to be supported is completely taken up by the pulley and the rope can run in the descender following rotation of the pulley in a semi-circle thereby preventing the formation of slipping areas and therefore of friction. The rope channel defines a semi-circle by means of the pulley. The rope is in contact with the pulley over half of the pulley. In advantageous manner, the outer wall of the pulley is devoid of overlap over more than half of the perimeter of the pulley thereby making it possible to have an almost total take-up of the force by the pulley. Take-up of the force by the pulley takes place whatever the position of the pulley between the first position and second position.

In comparison, document US 2014/0262611 proposes a configuration with a movable cam a part of the support wall of which is formed by a pulley so as to modulate the friction force according to the speed of translation of the rope. The rest of the support wall is formed by a friction area present on each side of a diameter of the pulley to provide the friction between the rope and clamping system. When the speed of translation is high, the pulley is clamped thus increasing the friction and resulting in rotation of the cam.

Descender 1 possesses a cam 5 or pad to perform clamping of rope 4 against side wall 3*a* of first flange 3. Rotation of pulley 2 and first axis of rotation A in the second direction of rotation results in a force inducing rotation of cam 5 around second axis of rotation B with a reduction of the distance between cam 5 and the clamping area until a threshold position representative of clamping of the rope is reached. Rotation of pulley 2 and first axis of rotation A in the first direction of rotation results in a force inducing rotation of cam 5 around second axis of rotation B with an increase of the distance between cam 5 and the clamping area to exit the clamping position of rope 4.

The use of a movable cam 5 distinct from pulley 2 and salient from pulley 2 ensures improved clamping of rope 4 between cam 5 and side wall 3*a*. Movement of pulley 2 moves cam 5 toward the clamping position thereby making it easier to achieve clamping of rope 4. Movement of pulley 2 advantageously enables cam 5 to be moved in order to increase the tension applied by cam 5 on rope 4 by moving the cam towards side wall 3*a* thereby making it easier to obtain a threshold friction force ensuring self-clamping of rope 4.

Cam 5 is fitted movable in rotation around a second shaft 26 that defines a second axis of rotation B distinct from first axis of rotation A. Cam 5 is fitted in rotary manner around second axis of rotation B so that the position of cam 5 with respect to the clamping area is linked to the position of first shaft 25.

As illustrated in FIGS. 3 and 4, first axis of rotation A is offset from second axis of rotation B so that application of a force on rope 4 to make pulley 2 rotate in first direction of rotation + generates a force moving cam 5 away from the clamping area. Application of a force on rope 4 to make pulley 2 rotate in second direction of rotation − generates a force moving cam 5 towards the clamping area.

The offset between the two spindles A and B results in generation of a torque when the first strand of rope 4 or the second strand of rope 4 is pulled. It is particularly advantageous to use this torque to move cam 5 or to generate a force for the purposes of moving cam 5. As illustrated in FIG. 3, the two spindles are separated by a distance that is smaller than the radius of pulley 2. Agular shift of the shaft of the pulley and of cam 5 is reduced thereby enabling a force take-up between the two positions by means of pulley 2 that varies very little with the direction of rotation required for the pulley. On the contrary, in the document US 2014/0262611, the spindle of the clamping mechanism is located at a distance from the pulley which means that a friction area is required to form the link between the pulley and spindle. The proposed configuration is then more bulky and results in more friction thereby reducing the efficiency when pulling on the rope strand that is not taut.

In a particular configuration, first axis of rotation A and second axis of rotation B are placed so that the weight of pulley 2 makes cam 5 leave the rope clamping position.

In a particular configuration, first axis of rotation A and second axis of rotation B are placed so that when the first rope strand is pulled, pulley 2 and cam 5 move away from the clamping position before pulley 2 starts to rotate around first axis of rotation A.

In an advantageous configuration, cam 5 is mounted fixed on first shaft 25, this configuration making it possible for example to have a rotation of cam 5 in identical manner to the rotation of second axis of rotation B.

It is also advantageous to provide an embodiment wherein first flange 3 comprises a first groove 6 and wherein the position of pulley 2 is represented by the position of an indicator in first groove 6. It is then possible to quickly determine whether clamping of rope 4 results from the position of pulley 2 or of another part. If the indicator operates in conjunction with a handle 12, the position of handle 12 provides an indication on the position of the indicator.

In advantageous manner illustrated in FIG. 8, pulley 2 and second axis of rotation B are fitted on support 7 associated with a first pin 8 passing through first groove 6. Movement of first pin 8 along first groove 6 results in rotation of support 7 in first direction of rotation + and in second direction of rotation −. Rotation of support 7 makes first pin 8 rotate. Support 7 moves between a first position and a second position. As illustrated, it advantageous to provide the second axis of rotation B of the support, the first axis of rotation A of the pulley 2 and the upper part of the fixing opening are not aligned. This configuration makes rotation of the blocking cam easier between the blocking position and the other position.

Preferentially, first flange 3 defines a second groove 9. The position of pulley 2 with respect to first flange 3 is represented by the position of the second indicator in second groove 9. Support 7 is associated with a second pin 10 passing through second groove 9. It is particularly advantageous to use a spring 11 fixed to first flange 3 to move pulley 2 to the second position, i.e. to move second pin 10 to facilitate clamping on rope 4. In the illustrated embodiment, spring 11 is configured to move pulley 2 in second direction of rotation − and to urge towards the clamping position of rope 4.

It is particularly advantageous to provide for spring 11 to be fixed to the second indicator, here second pin 10, so as not to interfere with the rotation of pulley 2 and with running of rope 4.

Figure 6:
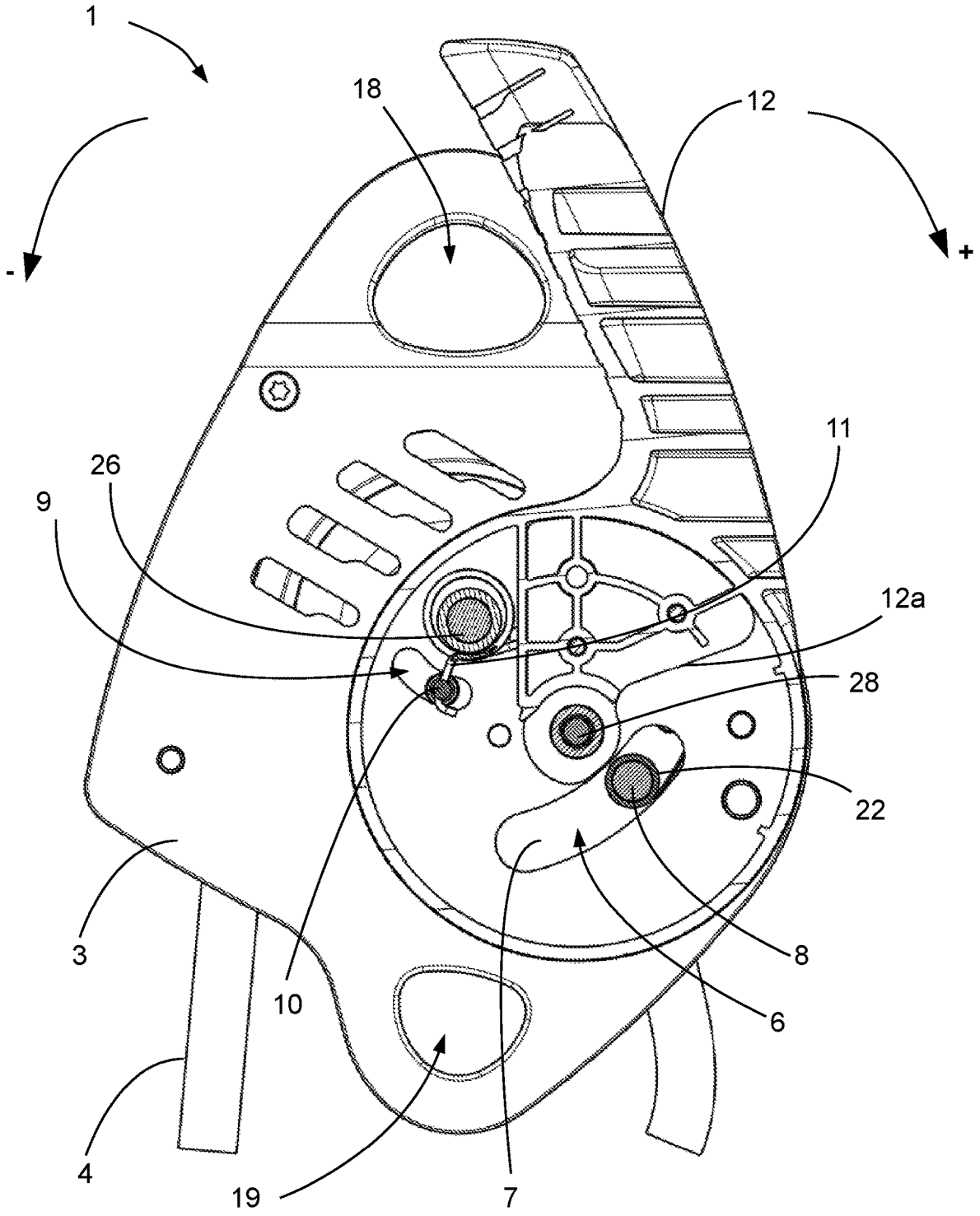
FIG. 6 illustrates in schematic manner, a rear view and in cross-section, an embodiment in which the cam is in the clamping position, the cross-section being taken in the thickness of the handle.
Figure 7:
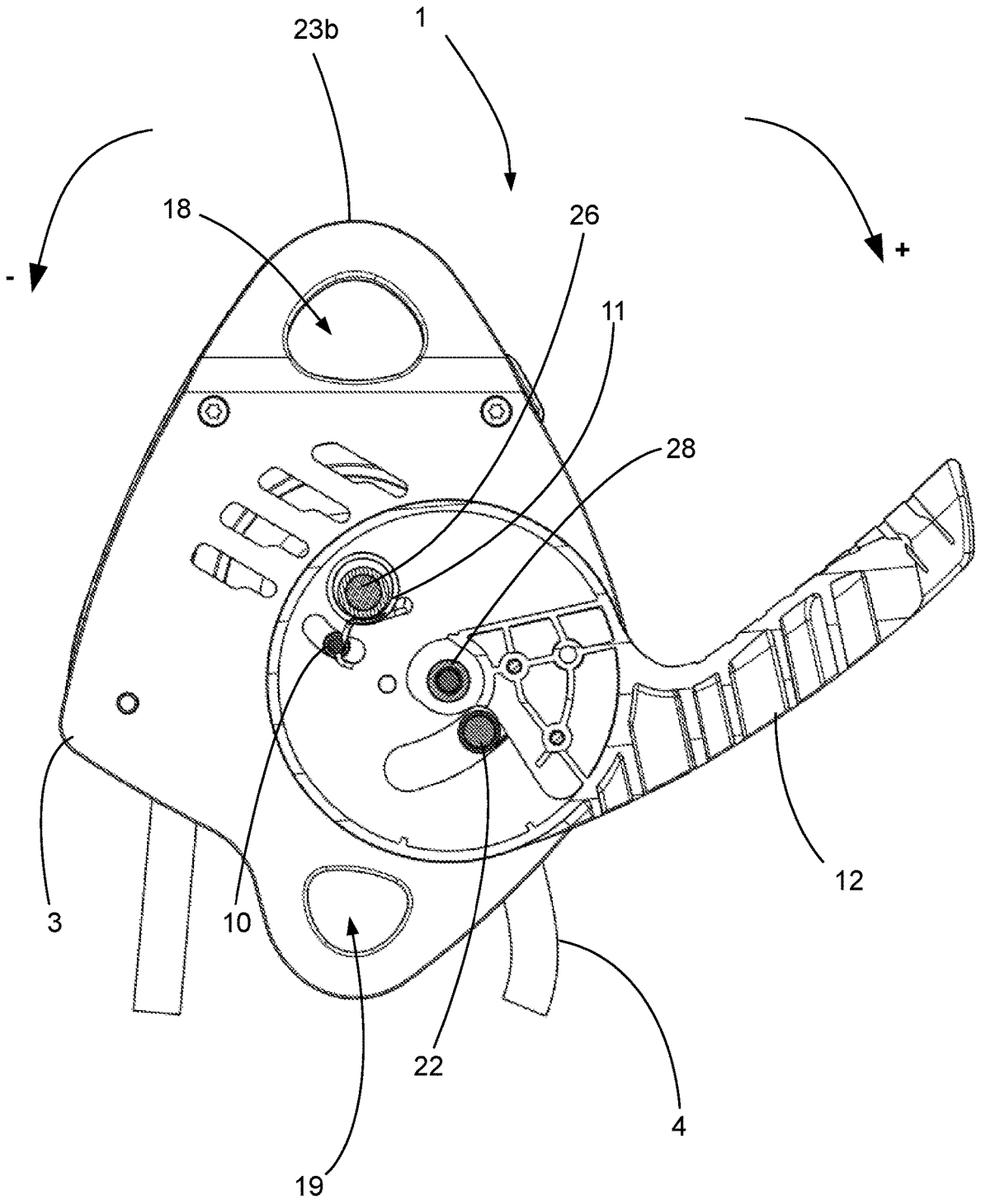
FIG. 7 illustrates in schematic manner, in cross-section, an embodiment in which the cam is in a position allowing the rope to slide, the cross-section being taken in the thickness of the handle.

In the embodiment illustrated in FIGS. 6 and 7, spring 11 is separated from pulley 2 by first flange 3 making for a compact architecture in running of rope 4. Spring 11 can be achieved by any known technique for example with a torsion, tension or compression coil spring. It is also possible to form a spring 11 by elastic deformation of one or more plates.

It is particularly advantageous to provide for spring 11 to be fitted around second axis of rotation B in order to gain in compactness.

In a particular embodiment, descender 1 comprises a handle 12 as illustrated in FIGS. 1 to 7. Handle 12 comprises a stop 12*a* arranged to come into contact with first pin 8. Rotation of handle 12 in first direction of rotation + results in stop 12*a* being brought into contact with the first pin followed by movement of the first pin in first direction of rotation +.

This embodiment is particularly advantageous when second pin 10 is associated with spring 11. Spring 11 is arranged to move pulley 2 to the clamping position.

Rotation of handle 12 from a standby position places stop 12*a* in contact with first pin 8. When handle 12 rotates, stop 12*a* presses on first pin 8 which then moves. Handle 12 exerts a force 12 opposing the force applied by the spring which moves pulley 2, and cam 5 if applicable. The stress applied on rope 4 decreases thereby enabling sliding of rope 4. Movement of handle 12 enables the distance between pulley 2/cam 5 and side wall 3*a* to be adjusted thereby enabling the intensity of the friction force and therefore the running speed of rope 4 in descender 1 to be adjusted.

In more general manner, it is advantageous to provide for spring 11 to move cam 5 to the clamping area, i.e. to move cam 5 to a clamping position of the rope so that, by default, cam 5 clamps rope 4 regardless of the intensity of the friction between rope 4 and pulley 2.

In this configuration, cam 5 is by default in a position clamping rope 4. By pulling on the first strand of rope 4, the torque generated opposes the spring thereby enabling movement of the pulley and movement of the cam. The cam no longer clamps the rope which can be pulled taking advantage of the rotation of the pulley to obtain a high level of performance when pulling.

Figure 5:
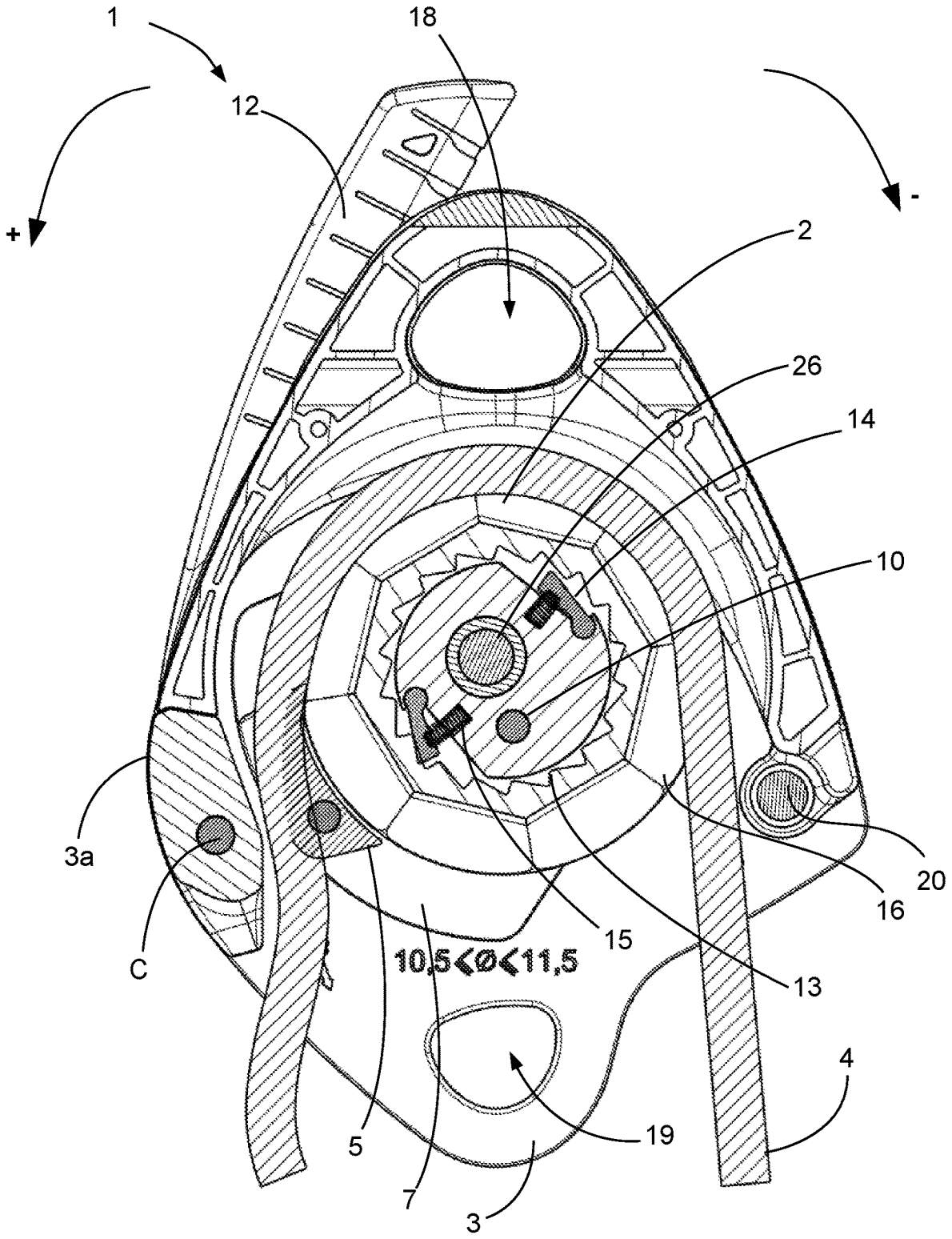
FIG. 5 illustrates in schematic manner, in cross-section, an embodiment in which the cam is in the clamping position, the cross-section being taken in the thickness of the pulley.

In the embodiment illustrated in FIG. 5, self-clamping descender 1 comprises a pulley 2 provided with a ratchet wheel 13 associated with at least one clamp 14 and with a spring 15 called clamping spring. Ratchet 13, at least one clamp 14 and spring 15 are arranged to allow rotation of pulley 2 in first direction of rotation + and to prevent rotation of pulley 2 in second direction of rotation −. This configuration is particularly advantageous as the clamping system in the second direction of rotation is located inside pulley 2 which does not hamper running of rope 4. In the illustrated embodiment, spring 15 is fitted in pulley 2 to facilitate its integration and the compactness of pulley 2. Other configurations are however possible.

Advantageously, pulley 2 comprises a plurality of flat spots 16 arranged in the groove of pulley 2 so as to define constrictions in the groove. These multiple reductions of the cross-section of the groove of pulley 2 form preferential friction areas when rope 4 has to slide along pulley 2. It is also possible to provide for the use of a smooth sheave or a faceted sheave. In one embodiment, the sheave can define a groove with a more or less pronounced V-shaped cross-section in order to define the friction force.

In advantageous manner, first flange 3 is associated with a second flange 17 that is fitted movable with respect to first flange 3. In advantageous manner, second flange 17 is fitted movable in rotation around a third spindle C. Rotation of second flange 17 enables descender 1 to be opened or closed as illustrated in FIGS. 1 and 2.

First flange 3 and second flange 17 each define a fixing opening 18. The two fixing openings 18 are placed facing one another so as to collaborate with a connector (not shown), for example a karabiner enabling descender 1 to be secured to a fixed point.

First flange 3 also defines a second fixing opening 19 for attaching a karabiner for example.

First flange 3 comprises a blocking stop 20 configured to prevent progression of second flange 17 to its closed position closing descender 1.

As illustrated in FIG. 8, it is possible to fit first axis of rotation 1 of pulley 2 on a support 7 so that the pulley can move with respect to first flange 3 with two different movements that may be simultaneous. The pulley rotates around first axis A and around second axis B.

In advantageous manner, cam 5 is fixed on support 7 by means of a fixing part 22 extending through first opening 6 to form first pin 8. Preferentially, fixing part 22 passes through support 7 until it reaches a second support 23. Second support 23 is fixed to first support 7. First support 7 and second support 24 are separated by pulley 2 and by cam 5. Cam 5 is fitted in fixed manner on support 7.

Preferentially, first pin 8 is surrounded by one or more bearings 24 to improve sliding in first groove 6.

Spindle A is advantageously defined by a shaft 25. Shaft 25 comprises a first through hole aligned with a first through hole of support 7 so as to be able to inserted in a second shaft 26 forming second axis of rotation B. In advantageous manner, second support 23 comprises a first hole aligned with the first hole of shaft 25 thus enabling rotation shaft 25, first support 7 and second support 23 to be fixed by means of second shaft 26.

In advantageous manner, shaft 25 also comprises a second through hole aligned with a second through hole of support 7 and possibly a second through hole of second support 23. A second rod forming pin 10 passes through the second through holes. The use of two series of through holes ensures that the movement applied on support 7 results in the same movement on shaft 25 and therefore on the first axis of rotation and on cam 5.

In a preferential embodiment, shaft 25 is separated from support 7 by a bearing 27 enabling rotation of shaft 25 with respect to support 7 to be improved thereby improving rotation of pulley 2 with respect to support 7.

Pulley 2 is of circular cross-section and presents a groove for rope 4 to run in. Pulley 2 is in the form of a ring in order to be able to fit first axis of rotation A in the centre of pulley 2. Pulley 2 advantageously defines a ratchet 13.

Ratchet 13 collaborates with clamps 14 fitted on shaft 25 and with springs 15 pressing on clamps 14, so as to offset clamps 14 to the outside and the teeth of ratchet 13.

In the illustrated embodiment, pulley 2 is mounted rotating by means of a bearing 21, for example a ball bearing inserted between pulley 2 and shaft 25. Shaft 25 defines first axis of rotation A and bearing 21 facilitates rotation of pulley 2 with respect to shaft 25.

The use of descender 1 can be described in the following manner. A self-clamping descender 1 according to one of the multiple embodiments described in the foregoing is provided. Rope 4 is fitted in descender 1.

The user pulls on the first strand of rope 4 which makes pulley 2 rotate in first direction of rotation +. The load attached to the second strand of rope 4 is hoisted.

The second strand of rope 4 is pulled to make pulley 2 rotate in second direction of rotation – which results in clamping of pulley 2. Pulley 2 moves in the direction of a side wall until clamping of rope 4 is achieved.

In the illustrated exemplary embodiment, the force applied on the second rope strand causes movement of support 7, here a rotational movement with a rotational movement of cam 5.

In a particular configuration, spring 11 moves support 7 to the clamping position so that descender 1 clamps rope 4 by default. When a tension is applied on the first strand of rope 4, pulley 2 moves so as to release clamping of rope 2 and allow rotation of pulley 2 and enhance the performance when hoisting the load present on the second strand of rope 4.

Once the tension on the first strand of rope 4 has been released, support 7 returns to the clamping position.

In the illustrated embodiment, the handle 12 is mounted movable around shaft 28 defining axis of rotation C.

The invention claimed is:

1. Self-clamping descender with pulley for a rope comprising:

a first flange provided with a rope clamping area, a rope channel designed to receive a rope, a pulley designed to come into contact with the rope and fitted in rotary manner around a first rotation shaft, the first rotation shaft being fixed to a support and defining a first axis of rotation, the pulley being configured to only rotate in a first direction of rotation around the first axis of rotation and to prevent rotation in the second direction of rotation around said first axis of rotation, the support fitted movable in rotation between a first position and a second position around a second rotation shaft fixed to the first flange, the second rotation shaft defining a second axis of rotation, a blocking cam fixed on the support, the blocking cam being movable in rotation with respect to the first flange around the second rotation shaft so as to move towards or away from the rope clamping area, wherein the first axis of rotation is offset from the second axis of rotation by a smaller distance than a radius of the pulley, the first rotation shaft is movable around the second axis of rotation and movable with respect to the rope clamping area, the first and second axis of rotation are arranged so that application of a force on the rope makes the pulley to rotate in the first direction of rotation generating a force urging the blocking cam away from the rope clamping area, and application of a force on the rope makes the pulley to rotate in the second direction of rotation generating a force urging the blocking cam towards the rope clamping area.

2. Self-clamping descender according to claim 1, wherein a spring is arranged to apply a force moving the blocking cam to the rope clamping area.

3. Self-clamping descender according to claim 2, wherein the spring is connected to the support and is arranged to move the first axis of rotation to a first position and wherein application of a force on the rope to achieve rotation of the pulley in the first direction of rotation moves first axis of rotation away from the first position.

4. Self-clamping descender according to claim 3, wherein the first flange comprises a second groove and wherein the support is associated with a second pin passing through the second groove, the spring being fixed to the first flange to move the second pin in the second direction of rotation.

5. Self-clamping descender according to claim 4, wherein the spring is fitted around the second axis of rotation.

6. Self-clamping descender according to claim 2, wherein the first flange comprises a second groove and wherein the support is associated with a second pin passing through the second groove, the spring being fixed to the first flange to move the second pin in the second direction of rotation.

7. Self-clamping descender according to claim 6, wherein the spring is fitted around the second axis of rotation.

8. Self-clamping descender according to claim 1, wherein, when the pulley moves in the first direction of rotation, the pulley is in a first position that is farther from the rope clamping area than a second position representative of clamping of the rope.

9. Self-clamping descender according to claim 1, wherein the first flange comprises:

a first groove and wherein the support is associated with a first pin passing through the first groove, movement of the first pin in the first direction of rotation along the first groove resulting in rotation of the support in the first direction of rotation, a handle comprising a stop arranged to come into contact with the first pin, rotation of the handle in the first direction of rotation causing rotation of the first pin in the first direction of rotation.

10. Self-clamping descender according to claim 1, wherein the second shaft passes through the pulley to form an end-of-travel stop collaborating with a groove formed in the second flange fitted in rotary manner on the first flange, the end-of-travel stop defining a closed position of the self-clamping descender.

11. Self-clamping descender according to claim 1, wherein the pulley comprises a ratchet wheel associated with at least one clamp and with a blocking spring, the ratchet wheel, at least one clamp and blocking spring being arranged to allow rotation of the pulley in the first direction of rotation and to prevent rotation in the second direction of rotation.

12. Self-clamping descender according to claim 1, wherein the pulley comprises a plurality of flat spots arranged in a groove of the pulley so as to define constrictions in the groove.

* * * * *